US008289817B1

(12) United States Patent
Bath

(10) Patent No.: US 8,289,817 B1
(45) **Date of Patent: *Oct. 16, 2012**

(54) SINGLE TOUCH ALARM CLOCK

(76) Inventor: Eugene R. Bath, Colorado Springs, CO (US)

( * ) Notice: Subject to any disclaimer, the term of this patent is extended or adjusted under 35 U.S.C. 154(b) by 298 days.

This patent is subject to a terminal disclaimer.

(21) Appl. No.: 12/383,105

(22) Filed: Mar. 20, 2009

(51) Int. Cl.
*G04B 23/02* (2006.01)

(52) U.S. Cl. ..... 368/244; 368/243; 368/261; 368/72

(58) Field of Classification Search ..... 368/72–74, 368/243, 244, 250, 261
See application file for complete search history.

(56) References Cited

U.S. PATENT DOCUMENTS 4,279,012 A * 7/1981 Beckedorff et al. ..... 700/16
4,301,524 A * 11/1981 Koepp et al. ..... 368/261
D268,758 S * 4/1983 Boldt et al. ..... D14/144
4,456,385 A * 6/1984 Hattori ..... 368/187
4,642,463 A * 2/1987 Thoms ..... 250/336.1
4,868,800 A * 9/1989 Arber ..... 368/29
5,883,859 A * 3/1999 Bentley ..... 368/10
6,696,924 B1 * 2/2004 Socinski ..... 700/213
6,795,375 B2 * 9/2004 Streja ..... 368/10
6,795,377 B2 * 9/2004 Gorden ..... 368/12
7,433,274 B1 * 10/2008 Bath ..... 368/73
7,457,204 B1 * 11/2008 Winters ..... 368/73

* cited by examiner

*Primary Examiner* — Renee Luebke
*Assistant Examiner* — Jason Collins
(74) *Attorney, Agent, or Firm* — G. F. Gallinger

(57) ABSTRACT

A touch lock guarantees reliable alarm activation comprises: a) an upright front display screen; b) a keypad, haying three separated groups of keys: a choice of alarm-time set function keys; a ten numeric key group positioned centrally on the keypad; and a AM-PM/Set function key. The clock can be fully operated by a single finger, using a maximum of six touches, providing assurance of entry of each touch, without the need to hold or grasp the clock, and without the need for a user to reorient himself from a position facing the clock, or to reorient the clock from its operable, optimally viewed orientation. After a user has easily and quickly set an alarm time by utilizing each of the three groups of keys, he then can at any time review his entries with a glance.

16 Claims, 1 Drawing Sheet

SINGLE TOUCH ALARM CLOCK

FIELD OF THE INVENTION

This invention relates to user friendly, and reliable alarm clocks. More particularly this invention relates to a fully touch key operated alarm clock which leads successively through 3 distinct functional steps, and thereafter continuously displays all entered data so that alarm time entry is efficient, rapid, and assured. The alarm clock can be fully set up with a succession of single touches. The alarm clock is configured so that a handicapped individual can enter all information with a mouth held stick, from in front of the alarm clock without holding the alarm clock.

BACKGROUND OF THE INVENTION

Digital alarm clocks are unnecessarily complicated in their alarm time set up. All too many individuals have missed important appointments when the alarm they thought they had correctly set up, did not awaken them. The volume may have been turned off. The switch may have been in the wrong position. Either the time of day or the alarm time may not have been set correctly. Either the clock or the alarm time may have been inadvertently set for PM when AM was intended. Setting the alarm prior to an important appointment is a procedure that must be undertaken, reconsidered, and then rechecked.

Many individuals do not regularly use an alarm. Many individuals have not adjusted their alarm for many months. Only occasionally when they must arise earlier do they need to adjust and rely on an alarm clock. They may not fully recollect how to ensure that the alarm clock rings for their early schedule. What is needed is an alarm clock with an intuitive keypad setup. An alarm clock which initially prompts and subsequently confirms entered information so that any time during or after information entry, the individual can simply glance at the face of the clock and confirm that what he intends is entered into the clock. It is also useful to have prompts which persist until each necessary selection is made. It is not unusual for an individual on a business trip to have a poor night's sleep prior to an important appointment. His body clock may have been thrown off and he cannot help waking up well in advance of his important appointment to ensure he arrives in a timely fashion. Hotels spend considerable time and energy on wake up calls. The desk clerks don't usually call at precise times. They don't even always call. What is needed is a failsafe alarm clock. A clock which is virtually foolproof in its alarm time entry, and a clock which visibly assures a conscientious individual that they will reliably be awakened on time.

Alarm clocks typically require two hands for set-up and the procedure is relatively complicated, frequently frustrating, and comparatively time consuming. They are neither intuitive or user friendly and preclude use by many handicapped individuals unable to access and manipulate multiple buttons and switches. A clock in which all data can be entered wholly through a readily accessible keypad not only facilitates use by handicapped individuals who otherwise would be unable to independently operate an alarm clock, but additionally facilitates rapid data entry by other individuals. Existing alarm clocks do not concurrently display more than one time parameter so that a user is forced to activate buttons or switches to review any programmed alarm time. What also is needed is an alarm clock that would continuously and concurrently show, at a glance, the time of day and all activated alarm times.

OBJECTS OF THE INVENTION

It is an object of this invention to disclose an alarm clock which is easy to set up. It is an object of this invention to disclose an alarm clock which is difficult to set up improperly. It is an object of this invention to disclose an alarm clock wherewith one intuitively enters information from left to right of a keypad and wherein flashing prompts progressively persist until a final AM-PM/set selection is made. It is an object of this invention to disclose an alarm clock for the handicapped which can be set up, without holding the clock, from a front side of the clock with a stick held in one's mouth. It is yet a further object of this invention to disclose an alarm clock which prompts a user to enter all data required thereby ensuring that all data is entered correctly. It is an object of this invention to disclose an alarm clock which continuously displays all active parameters and which is configured to only and always activate audibly an alarm when the alarm is displayed, so that a user is continuously assured that he will be awakened at the alarm time being displayed. It is yet a further object of this invention to provide the best possible assurance of alarm activation at the time displayed. It is a final object of this invention to promote better sleep for those who have an important early appointment to attend.

One aspect of this invention provides for a fully touch key operated alarm clock which can be fully operated with a succession of touches with a single finger, which gives full and continuous visual assurance of every keystroke, which guarantees accurate and complete data entry, as well as reliable alarm activation, and in which alarm times can be quickly and easily set through a self directing key arrangement which makes obvious an orderly three step, progressive data entry process. The alarm clock comprises: a) an upright front display screen having a 4 digit time of-day display portion and a 4 digit alarm display portion; b) a lateral keypad positioned beneath the display screen, said keypad having three separated and widely distinctive groups of keys, each group configured and located for the incredibly fast, obvious, and orderly progression of data entry; necessitating three intuitive group entries: i) a first group of keys—provides choice of alarm-time set function keys; ii) a second group of keys—provides a ten numeric key group positioned centrally on the keypad, and numbered 0-9 for entering numbers; and a third group of keys—provides AM-PM/Set function keys, to finalize any alarm setting sequence. The clock can be fully operated by touch alone with a single finger, using a maximum of six touches, thereby providing visual feedback and assurance of the propriety of entry of each touch, without the need to hold or grasp the clock, and without the need for a user to reorient himself from a position facing the clock, or to reorient the clock from its operable, optimally viewed orientation. After a user has easily and quickly set an alarm time by utilizing each of the three groups of keys, he then can at any time review his entries with a glance.

In a preferred aspect of this invention the first group of keys are located on the left side portion of the keyboard; the second group of keys are located on a central portion of the keyboard, to the right of the first group of keys; and, the third group of keys are located on the right portion of the keyboard to the right of the second group of keys. Then a complete data entry will comprise an entry from each group of keys in an intuitive left to right coverage of the keyboard.

In the most preferred embodiment of the invention the clock is configured so that the alarm will invariably and audibly sound when an alarm time is displayed so that a user can be confident that nothing has been forgotten and that he will always be awakened at the displayed alarm time.

In yet another aspect of this invention the clock is configured so that a handicapped individual, without holding the alarm clock, can entirely make all settings from a front side portion of the clock with a stick held in his mouth.

Various other objects, advantages and features of this invention will become apparent to those skilled in the art from the following description in conjunction with the accompanying drawings.

FIGURES OF THE INVENTION

Figure 1:
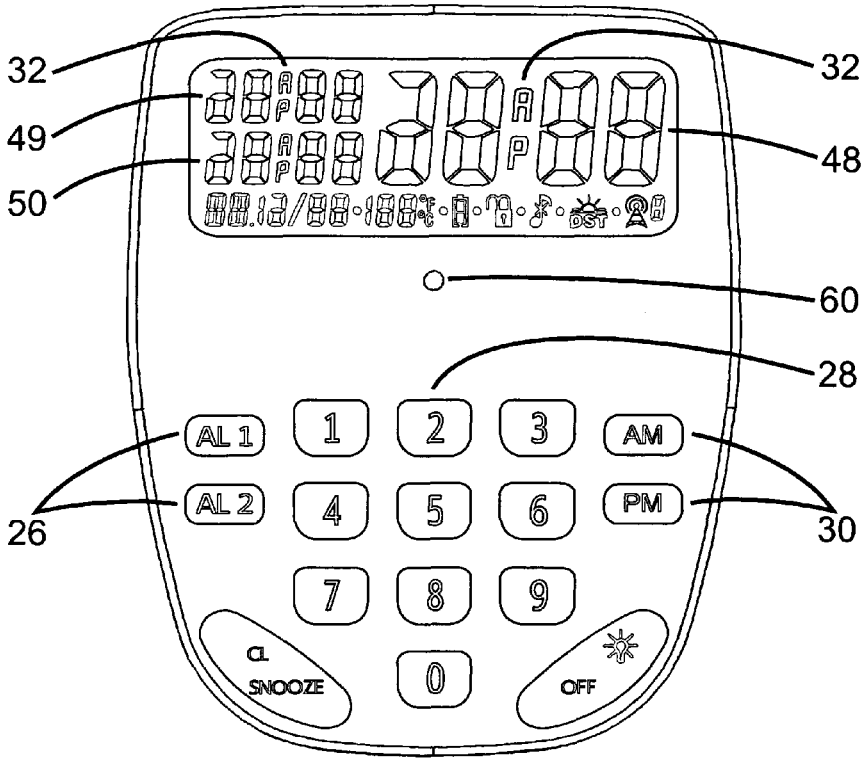
FIG. 1 is a plan view of a rapid set alarm clock.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Figure 2:
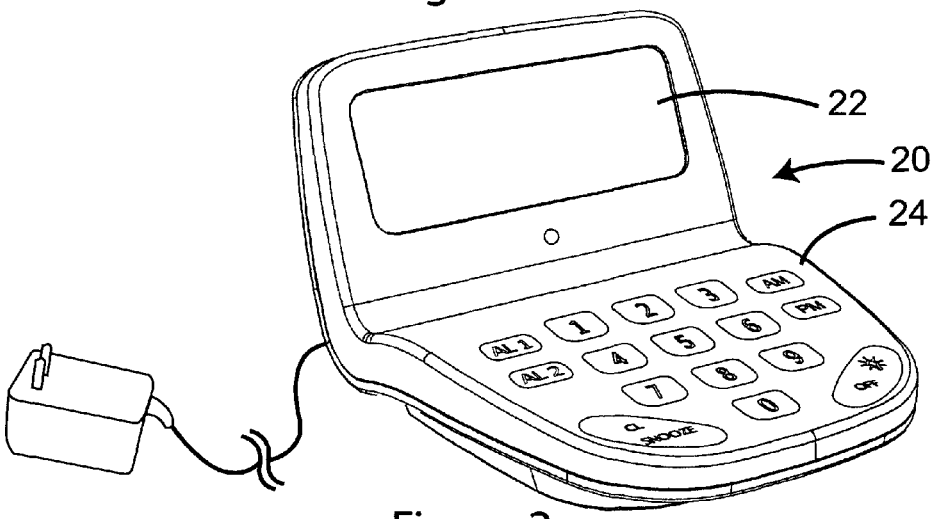
FIG. 2 is a perspective view of the alarm clock shown in FIG. 1.

Turning now to the drawings and more particularly to FIGS. 1 and 2 we have a plan and perspective view of a single touch operated alarm clock 20. Most generally a fully touch key operated alarm clock 20 which can be fully operated with a succession of touches with a single finger, which gives full and continuous visual assurance of every keystroke, which guarantees accurate and complete data entry, as well as reliable alarm activation, and in which alarm times can be quickly and easily set through a self directing key arrangement which makes obvious an orderly three step, progressive data entry process, comprises: a) an upright front display screen 22 having a 4 digit time-of-day display portion and a 4 digit alarm display portion; b) a lateral keypad 24 positioned beneath the display screen 22, said keypad 24 having three separated and widely distinctive groups of keys, each group configured and located for the incredibly fast, obvious, and orderly progression of data entry; necessitating three intuitive group entries: i) a first group of keys—provides choice of alarm-time set function keys 26; ii) a second group of keys—provides a ten numeric key group 28 positioned centrally on the keypad 24, and numbered 0-9 for entering numbers; and iii) a third group of keys—provides AM-PM/Set function keys 30, to finalize any alarm setting sequence. The clock 20 can be fully operated by touch alone with a single finger, using a maximum of six touches, thereby providing visual feedback and assurance of the propriety of entry of each touch, without the need to hold or grasp the clock 20, and without the need for a user to reorient himself from a position facing the clock, or to reorient the clock from its operable, optimally viewed orientation. After a user has easily and quickly set an alarm time by utilizing each of the three groups of keys 26,28,30 he then can at any time review his entries with a glance.

In a preferred embodiment of the invention the first group of keys 26 are located on the left side portion of the keyboard 24; the second group of keys are located 28 on a central portion of the keyboard 24, to the right of the first group of keys 26; and, the third group of keys 28 are located on the right portion of the keyboard to the right of the second group of keys 26. With this configuration a complete data entry will comprise an entry from each group of keys 26,28,30 in an intuitive left to right coverage of the keyboard 24.

In the most preferred embodiment of the invention the clock 20 is configured so that the alarm will invariably and audibly sound when an alarm time is displayed. This ensures that a user can be confident that nothing has been forgotten and that he will be awakened at the displayed alarm time. In the most preferred embodiment of the invention the clock 20 further comprises a required data entry indicator which is activated when, and only when, entry of data is commenced, but data entry is incomplete.

Most preferably if data entry indicator is commenced and the required data indicator is activated, if data entry is not completed within a limited time, the clock display screen 22 displays an error message and then deletes data. The required data entry indicator is intended to comprise an audible indicator, or a variable intensity indicator which indicates until, and only until, entry of all data is completed for a selected function.

In the most preferred embodiment of the invention the time display digits 48 are larger than the alarm display digits 50. The display screen 22 provides for two smaller 4 digit alarm display portions 49. There are two alarm set function keys 26 so that the alarm clock 20 can be set for two different times. AM/PM selection indicators 32 are provided for on the display screen 22.

In the most preferred embodiment of the invention the keypad is beneath and in front of the display screen 22 and the keyboard 24 is inclined, so that a handicapped individual may enter all information from a front side portion of the alarm clock, without the need to hold the alarm clock 20, and with a mouth held stick which is used to downwardly depress keys on the keyboard 24, one key at a time.

In another aspect of the invention the alarm clock 20 the display screen 22 is back lit and the brightness level is controllable by touching a selected numeric key, wherein a key having a lower numeric value is less bright than a key having a higher numeric value. Most preferably an ambient light level sensor 60 is used to increase display brightness to a predetermined light level when the ambient light level is falls below a preselected level. Most preferably the alarm clock 20 is configured so that a displayed alarm time can be deactivated and held in memory by pressing a corresponding alarm set function key 26 for an extended period. An alarm time held in memory can be reactivated by again pressing the corresponding alarm set function key 26 for an extended period.

A quick and reliable general method of time entry providing continuous confirmation of both alarm clock 20 operation and alarm activation comprises the steps of: a) providing an alarm clock 20 as specified in claim 2; b) facing the front of the clock 20 thereby viewing the display screen 22, the time set function keys 26, the numeric key group 28, and the AM-PM Set selection keys 30; c) without holding the clock 20, selecting by touching one of the time set function keys 26, giving feedback on the display screen, and confirming to the user that said function has been selected for data entry; d) touching keys in the numeric key group 28 positioned immediately to the right of the time set function keys 26 to enter a numeric value corresponding to the desired time, thereby displaying the numeric value on the display screen 22, and thereafter, e) touching an AM-PM Set function key 30, positioned on a right side portion of the keypad 24. The clock 20 can be set, reset, and reviewed with ultimate convenience by pressing one key at a time, with a single hand, without holding or grasping the clock 20, and without the user reorienting from a position facing the clock 20, or reorienting the clock 20 from its operable, optimally viewed orientation.

When said clock 20 is configured so that the alarm will invariably and audibly sound when an alarm time is displayed then a user can be confident that nothing has been forgotten and that he will be awakened at the displayed alarm time. The above method may be further modified when the clock 20 further comprises an incomplete data entry indicator. The indicator activates after pressing one of the time set function keys 26, prompting the user to make an entry from each of the second and third groups of keys, and when and only an entry has been completed by using the three groups of keys said indicator prompt is discontinued. A user is prompted to fully enter all data for each of the time set functions by using first the left, then the central, and finally the right portion of the keypad, and wherein indicator is activated until, and only until, all data is fully entered, thereby assuring complete data entry.

In the most preferred embodiment of the invention touching one of the time set function keys 26, causes the display screen 22 to flash to confirm to the user that said function has been selected for data entry. Said flashing continues until the user makes an AM-PM Set selection, and whereafter said selection is made the flashing is discontinued.

While the invention has been described with preferred specific embodiments thereof, it will be understood that this description is intended to illustrate and not to limit the scope of the invention, which is defined by the following claims.

I claim:

1. A touch key operated alarm clock in which all time entries can be entered and set with a succession of touches with a single finger, which gives visual assurance of keystrokes, to thereby ensure accurate entry of data, as well as alarm activation, and in which the setting of all times consists of using three separated singularly functional key groups for time entry in three progressive steps, comprises:

a) a front facing display screen having a time display portion to display time-of-day and alarm time;

b) a lateral keypad consisting of three separated, singularly functional groups of keys for time entry; each group configured and located for the progressive entry of data, which consists of an entry in each of the groups of keys:

i) a first functional group of keys which provides only a choice of clock time-set function keys;

ii) a second functional group of keys, which provides only a ten numeric key group numbered 0-9 for entering numbers; and, iii) a third functional group of keys which provides only a choice of AM-PM/Set function keys, to finalize any time setting sequence;

so that all time entries can be entered and set by touch alone with a single finger, using a maximum of six touches, thereby providing visual feedback and assurance of not only accurate but complete entry, without any need to hold or grasp the clock, and without any need for a user to reorient himself from a position facing the clock, or to reorient the clock from its operable, optimally viewed orientation; and, so that after a user has set an alarm time, consisting of an entry in each of the three functional groups of keys, he then can at any time review all his entries.

2. An alarm clock as in claim 1 wherein the first group of keys are located on a left side portion of a keyboard; the second group of keys are located on a central portion of the keyboard, to a right of the first group of keys; and, the third group of keys are located on a right portion of the keyboard to a right of the second group of keys;

so that a complete data entry will comprise an entry from each group of keys in a left to right coverage of the keyboard.

3. An alarm clock as in claim 2 further comprising an incomplete data entry indicator which is activated when, and only when, entry of data is commenced, but is incomplete.

4. An alarm clock as in claim 3 wherein if the incomplete data entry indicator is activated and, if data entry is not completed within a limited time, the clock display screen displays an error message before deleting data entered.

5. An alarm clock as in claim 4 wherein the display screen is back lit and a brightness level is controllable by touching a numeric key, wherein a key having a lower numeric value is less bright than a key having a higher numeric value.

6. An alarm clock as in claim 5 further comprising an ambient light level sensor used to decrease display brightness to a predetermined light level when ambient light falls below a preselected brightness.

7. An alarm clock as in claim 3 wherein the incomplete data entry indicator comprises one of an audible indicator, and a variable intensity indicator which indicates until, and only until, entry of all data is completed for a selected function.

8. An alarm clock as in claim 2 wherein the keypad is beneath and in front of the display screen and wherein the keyboard is inclined, so that a handicapped individual may enter all information from a front side portion of the alarm clock, without the need to hold the alarm clock, and with a mouth held stick which is used to downwardly depress keys on the keyboard, one key at a time.

9. An alarm clock as in claim 1 wherein said clock is configured so that the alarm will always sound at a displayed alarm time when an alarm time is displayed.

10. An alarm clock as in claim 9 wherein the time of day display digits are larger than the alarm display digits and wherein the display screen provides for two smaller four digit alarm display portions and where there are two alarm set function keys so that the alarm can be set for two different times.

11. An alarm clock as in claim 1 wherein a displayed alarm time can be deactivated and held in memory by pressing a corresponding alarm set function key.

12. An alarm clock as in claim 11 wherein an alarm time held in memory can be reactivated by again pressing a corresponding alarm set function key.

13. A method of time entry providing continuous confirmation of both alarm clock operation and alarm activation comprising the steps of:

a) obtaining an alarm clock as specified in claim 1;

b) facing a front of the clock thereby viewing the display screen, the three atoms of keys, and then, without holding the clock;

c) touching a key in the first group of keys to thereby choose a clock time-set function;

d) consecutively touching three to four keys in the second group of keys to thereby enter a clock time;

e) touching a key in the third group of keys to thereby choose either AM or PM for the time entered, thereby finalizing a time entry sequence;

f) reviewing entered data for any of the time set functions continuously displayed on the alarm clock;

so that the clock can be set by pressing one key at a time, with a single finger; without holding or grasping the clock, and without the user reorienting from a position facing the clock, or reorienting the clock from its operable, optimally viewed orientation; and, so thereafter the user can be assured, by viewing selected times, which are continuously displayed, that the alarm on the clock is correctly activated.

14. A method as in claim 13 wherein said clock is configured so that the alarm will always audibly sound at a displayed alarm time when an alarm time is displayed.

15. A method as in claim 14 wherein after pressing one of the time set function keys, an incomplete data entry indicator prompts the user to make an entry from each of the second and third groups of keys, and when and only when an entry has been completed by using the three groups of keys said indicator prompt is discontinued;

so that a user is prompted to fully enter all data for each of the time set functions and wherein the incomplete data entry indicator is activated when, and only when, entry of data is commenced, but is incomplete, thereby assuring complete data entry.

16. A method as in claim 14 wherein touching one of the time set function keys, causes a portion of the display screen to flash to confirm to the user that said function has been selected for data entry; and wherein said flashing continues until the user makes an AM/PM selection, and after said selection is made the flashing is discontinued.

* * * * *